US010704406B2

(12) United States Patent
Walunj et al.

(10) Patent No.: US 10,704,406 B2
(45) Date of Patent: Jul. 7, 2020

(54) TURBOMACHINE BLADE COOLING STRUCTURE AND RELATED METHODS

(71) Applicant: General Electric Company, Schenectady, NY (US)

(72) Inventors: Jalindar Appa Walunj, Bangalore (IN); Shashwat Swami Jaiswal, Bangalore (IN); Stephen Paul Wassynger, Simpsonville, SC (US); Xiuzhang James Zhang, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 398 days.

(21) Appl. No.: 15/620,896

(22) Filed: Jun. 13, 2017

(65) Prior Publication Data

US 2018/0355727 A1 Dec. 13, 2018

(51) Int. Cl.
*F01D 11/08* (2006.01)
*F01D 5/22* (2006.01)
(Continued)

(52) U.S. Cl.
CPC ..... *F01D 11/08* (2013.01); *F01D 5/18* (2013.01); *F01D 5/186* (2013.01); *F01D 5/187* (2013.01); *F01D 5/225* (2013.01); *F01D 11/10* (2013.01); *F05D 2240/303* (2013.01); *F05D 2240/307* (2013.01); *F05D 2260/2212* (2013.01);
(Continued)

(58) Field of Classification Search
CPC . F01D 5/088; F01D 5/225; F01D 5/18; F01D 5/20; F01D 5/189; F01D 11/08; F01D 5/186; F01D 5/187; F01D 11/10; F05D 2240/303
See application file for complete search history.

(56) References Cited

U.S. PATENT DOCUMENTS 6,146,098 A 11/2000 Fukuno et al.
6,152,695 A 11/2000 Fukue et al.
(Continued)

FOREIGN PATENT DOCUMENTS

DE 102016124296 A1 6/2017
EP 2378076 A1 10/2011
(Continued)

OTHER PUBLICATIONS

European Search Report Corresponding to EP Application No. 181758210 dated Nov. 2, 2018.

*Primary Examiner* — Brian P Wolcott
(74) *Attorney, Agent, or Firm* — Dority & Manning, P.A.

(57) ABSTRACT

A blade for a turbomachine includes an airfoil extending radially between a root and a tip with a tip shroud coupled to the tip of the airfoil. The tip shroud includes a platform having an outer surface extending generally perpendicular to the airfoil. The tip shroud also includes a forward rail extending radially outward from the outer surface of the platform. The forward rail is oriented generally perpendicular to a hot gas path of the turbomachine. A cooling cavity is defined in a central portion of the platform. The tip shroud also includes a cooling channel extending between the cooling cavity and an ejection slot formed in the forward rail. The ejection slot is positioned radially outward of the outer surface of the platform of the tip shroud.

20 Claims, 9 Drawing Sheets

(51) Int. Cl.
*F01D 5/18* (2006.01)
*F01D 11/10* (2006.01)

(52) U.S. Cl.
CPC ..... *F05D 2260/2214* (2013.01); *F05D 2260/22141* (2013.01)

(56) References Cited

U.S. PATENT DOCUMENTS 6,494,678 B1 * 12/2002 Bunker ..... F01D 5/18 415/115
7,632,062 B2 * 12/2009 Harvey ..... F01D 5/20 415/115
7,686,581 B2 3/2010 Brittingham et al.
7,946,816 B2 5/2011 Brittingham
8,057,177 B2 11/2011 Brittingham
8,061,987 B1 * 11/2011 Liang ..... F01D 5/186 416/92
8,066,485 B1 * 11/2011 Liang ..... F01D 5/186 415/115
8,113,779 B1 * 2/2012 Liang ..... F01D 5/20 416/92
8,313,301 B2 11/2012 Hudson
8,414,265 B2 * 4/2013 Willett, Jr. ..... F01D 5/20 416/228
8,920,123 B2 * 12/2014 Lee ..... F01D 5/186 416/92
8,956,104 B2 * 2/2015 Lacy ..... F01D 5/225 415/115
8,967,972 B2 3/2015 Brandl et al.
10,184,342 B2 1/2019 Zhang et al.
10,301,945 B2 5/2019 Chouhan et al.
2011/0255990 A1 10/2011 Diamond et al.
2012/0070309 A1 3/2012 Zambetti et al.
2014/0023497 A1 1/2014 Giglio et al.
2017/0089206 A1 * 3/2017 Quach ..... F01D 5/187

FOREIGN PATENT DOCUMENTS

EP 2385215 A1 11/2011
EP 2581558 A1 4/2013
EP 3244011 A2 11/2017
GB 2434842 A 8/2007

* cited by examiner

TURBOMACHINE BLADE COOLING STRUCTURE AND RELATED METHODS

FIELD

The present disclosure generally relates to turbomachines. More particularly, the present disclosure relates to blade cooling structures for turbomachines and related methods.

BACKGROUND

A gas turbine engine generally includes a compressor section, a combustion section, a turbine section, and an exhaust section. The compressor section progressively increases the pressure of air entering the gas turbine engine and supplies this compressed air to the combustion section. The compressed air and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected to a generator to produce electricity. The combustion gases then exit the gas turbine engine through the exhaust section.

The turbine section generally includes a plurality of blades coupled to a rotor. Each blade includes an airfoil positioned within the flow of the combustion gases. In this respect, the blades extract kinetic energy and/or thermal energy from the combustion gases flowing through the turbine section. Certain blades may include a tip shroud coupled to the radially outer end of the airfoil. The tip shroud reduces the amount of combustion gases leaking past the blade.

The blades generally operate in extremely high temperature environments. As such, the rotor blades may define various passages, cavities, and apertures through which cooling air may flow. In particular, the tip shrouds may define various cavities therein through which the cooling air flows. The cooling air then exits the blade through various ejection slots, including ejection slots in the tip shroud. Some of the ejection slots may enable the cooling air exiting the blade to mix with the high temperature combustions gases. Such mixing may negatively impact the efficiency of the turbomachine.

BRIEF DESCRIPTION

Aspects and advantages will be set forth in part in the following description, or may be obvious from the description, or may be learned through practice.

In one aspect, the present disclosure is directed to a blade for a turbomachine. The blade includes an airfoil extending radially between a root and a tip. The airfoil includes a pressure side surface extending from a leading edge to a trailing edge and a suction side surface extending from the leading edge to the trailing edge opposite the pressure side surface. A tip shroud is coupled to the tip of the airfoil. The tip shroud includes a platform having an outer surface that extends generally perpendicularly to the airfoil. The platform also has a forward surface proximate to the leading edge of the airfoil, an aft surface proximate to the trailing edge of the airfoil, a first side surface extending between the forward surface and the aft surface proximate to the pressure side surface of the airfoil, and a second side surface extending between the forward surface and the aft surface generally parallel to the suction side surface of the airfoil. The tip shroud also includes a forward rail extending radially outward from the outer surface of the platform proximate to the forward surface of the platform. The forward rail and the forward surface of the platform are oriented generally perpendicular to a hot gas path of the turbomachine. The tip shroud also includes a cooling cavity defined in a central portion of the platform of the tip shroud and a cooling channel extending between the cooling cavity and an ejection slot formed in the forward rail. The ejection slot is positioned radially outward of the outer surface of the platform of the tip shroud.

In another aspect, the present disclosure is directed to a gas turbine engine including a compressor, a combustor disposed downstream from the compressor, and a turbine disposed downstream from the combustor. The turbine includes a rotor shaft extending axially through the turbine, an outer casing circumferentially surrounding the rotor shaft to define a hot gas path therebetween, and a plurality of rotor blades interconnected to the rotor shaft and defining a stage of rotor blades. Each rotor blade includes an airfoil extending radially between a root and a tip. The airfoil includes a pressure side surface extending from a leading edge to a trailing edge and a suction side surface extending from the leading edge to the trailing edge opposite the pressure side surface. A tip shroud is coupled to the tip of the airfoil. The tip shroud includes a platform having an outer surface that extends generally perpendicularly to the airfoil. The platform also has a forward surface proximate to the leading edge of the airfoil, an aft surface proximate to the trailing edge of the airfoil, a first side surface extending between the forward surface and the aft surface proximate to the pressure side surface of the airfoil, and a second side surface extending between the forward surface and the aft surface proximate to the suction side surface of the airfoil. The tip shroud also includes a forward rail extending radially outward from the outer surface of the platform proximate to the forward surface of the platform. The forward rail and the forward surface of the platform are oriented generally perpendicular to a hot gas path of the turbomachine. The tip shroud also includes a cooling cavity defined in a central portion of the platform of the tip shroud and a cooling channel extending between the cooling cavity and an ejection slot formed in the forward rail. The ejection slot is positioned radially outward of the outer surface of the platform of the tip shroud.

According to another aspect of the present disclosure, a method of forming a cooling channel in a tip shroud of a blade for a turbomachine is provided. The method includes plugging an existing ejection slot of a cooling channel defined in the tip shroud. The method also includes forming a new ejection slot radially outward of the existing ejection slot and forming a bore from the new ejection slot to an intermediate portion of the cooling channel.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present embodiments, including the best mode thereof, directed to one of ordinary skill in the art, is set forth in the specification, which makes reference to the appended figures, in which.

DETAILED DESCRIPTION

Figure 1:
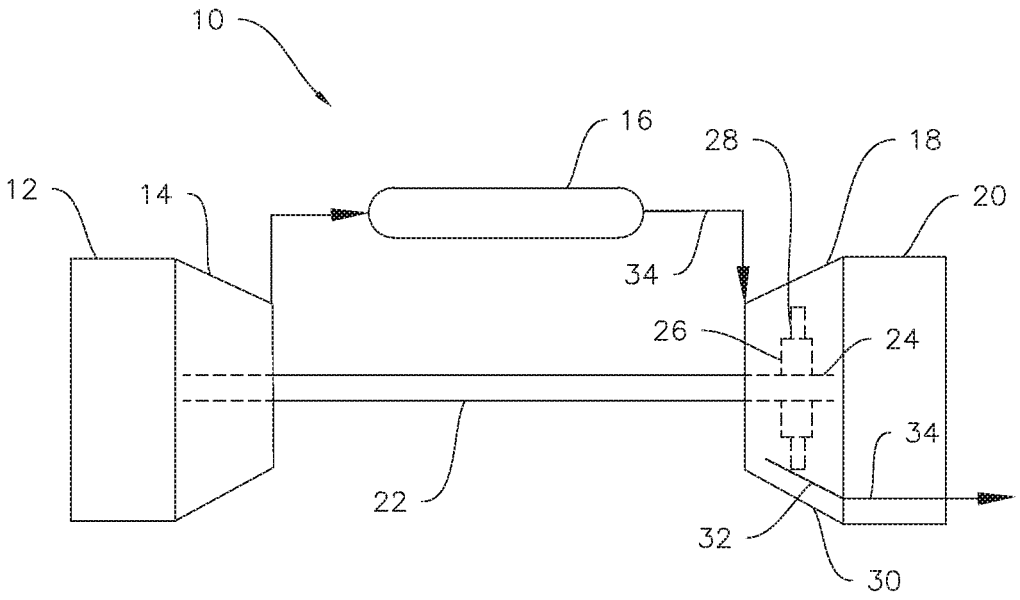
FIG. 1 is a schematic view of an exemplary gas turbine engine which may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a land based power generating gas turbine combustor for purposes of illustration, one of ordinary skill in the art will readily appreciate that embodiments of the present disclosure may be applied to any style or type of turbomachine and are not limited to land based power generating gas turbines unless specifically recited in the claims.

Referring now to the drawings, wherein identical numerals indicate the same elements throughout the figures, FIG. 1 schematically illustrates a gas turbine engine 10. It should be understood that the gas turbine engine 10 of the present disclosure need not be a gas turbine engine, but rather may be any suitable turbomachine, such as a steam turbine engine or other suitable engine. The gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may generally include a rotor shaft 24 having a plurality of rotor disks 26 (one of which is shown) and a plurality of rotor blades 28 extending radially outward from and being interconnected to the rotor disk 26. Each rotor disk 26, in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, air or another working fluid flows through the inlet section 12 and into the compressor section 14, where the air is progressively compressed to provide pressurized air to the combustors (not shown) in the combustion section 16. The pressurized air mixes with fuel and burns within each combustor to produce combustion gases 34. The combustion gases 34 flow along the hot gas path 32 from the combustion section 16 into the turbine section 18. In the turbine section, the rotor blades 28 extract kinetic and/or thermal energy from the combustion gases 34, thereby causing the rotor shaft 24 to rotate. The mechanical rotational energy of the rotor shaft 24 may then be used to power the compressor section 14 and/or to generate electricity. The combustion gases 34 exiting the turbine section 18 may then be exhausted from the gas turbine engine 10 via the exhaust section 20.

Figure 2:
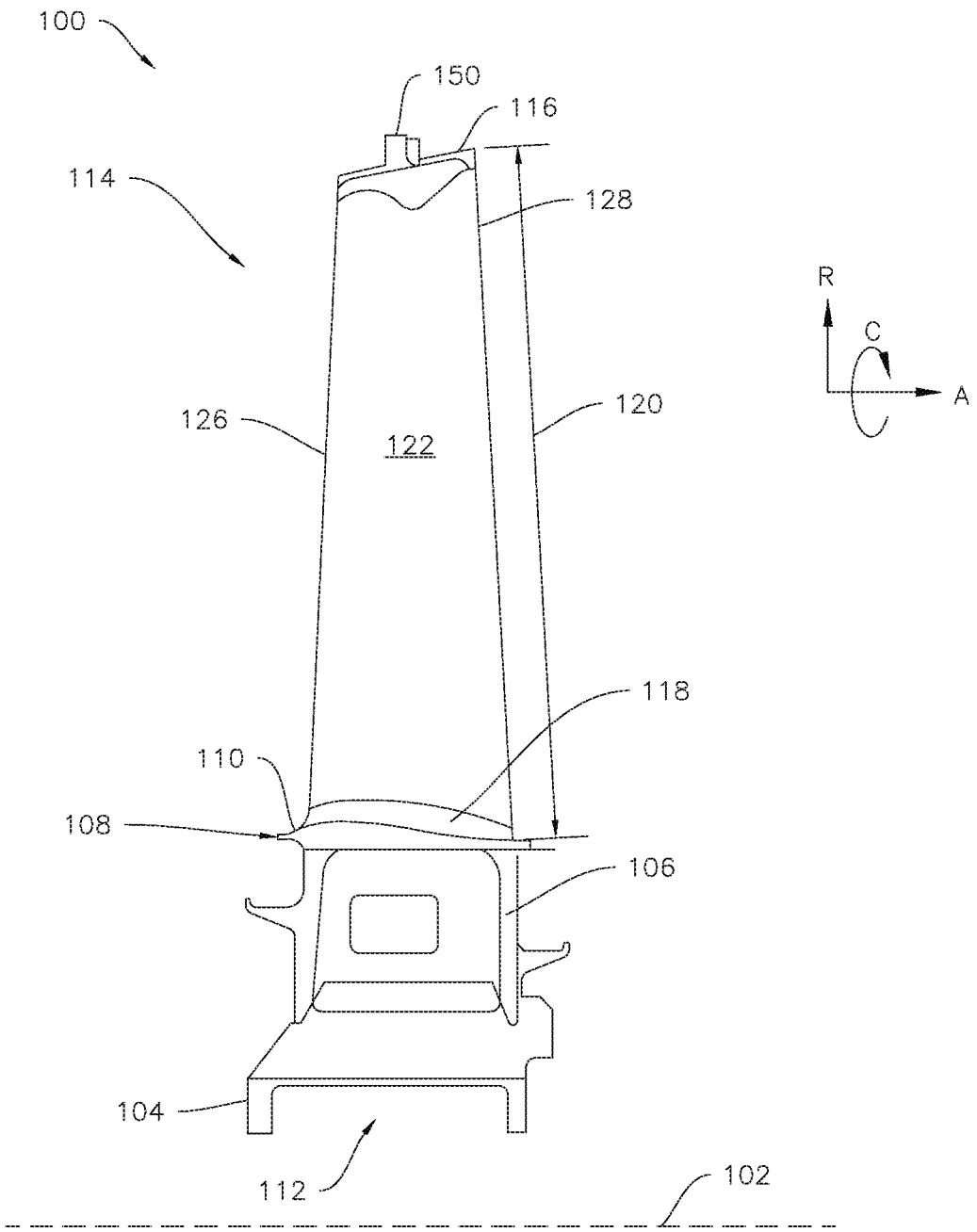
FIG. 2 is a front view of an exemplary blade according to one or more embodiments of the present disclosure.

FIG. 2 is a view of an exemplary rotor blade 100, which may be incorporated into the turbine section 18 of the gas turbine engine 10 in place of the rotor blade 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102. The rotor blade 100 may also be incorporated into the compressor section 14 of the gas turbine engine 10 (FIG. 1). As used herein, terms of approximation, such as "about," "generally," or "approximately," refer to being within ten percent above or below a stated value. Further, as used herein, such terms in the context of an angle or direction include within ten degrees. For example, "generally orthogonal" may include any angle within ten degrees of orthogonal, e.g., from eighty degrees to one hundred degrees.

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, shank portion 106, and platform 108 may define an intake port 112, which permits a cooling flow 36, such as cooling air (e.g., bleed air from the compressor section 14) to enter the rotor blade 100. In some embodiments, the dovetail 104 may include an axial entry fir tree-type dovetail. Alternately, the dovetail 104 may be any suitable type of dovetail. In fact, the dovetail 104, shank portion 106, and/or platform 108 may have any suitable configurations.

The rotor blade 100 further includes an airfoil 114. In particular, the airfoil 114 extends radially outward from the radially outer surface 110 of the platform 108 to a tip shroud 116. The airfoil 114 couples to the platform 108 at a root 118 (i.e., the intersection between the airfoil 114 and the platform 108). In this respect, the airfoil 114 defines an airfoil span 120 extending between the root 118 and the tip shroud 116. The airfoil 114 also includes a pressure side surface 122 and an opposing suction side surface 124. The pressure side surface 122 and the suction side surface 124 are joined together or interconnected at a leading edge 126 of the airfoil 114, which is oriented into the flow of combustion gases 34 (FIG. 1). The pressure side surface 122 and the suction side surface 124 are also joined together or interconnected at a trailing edge 128 of the airfoil 114 spaced downstream from the leading edge 126. The pressure side surface 122 and the suction side surface 124 are continuous about the leading edge 126 and the trailing edge 128. The pressure side surface 122 is generally concave, and the suction side surface 124 is generally convex.

Figure 3:
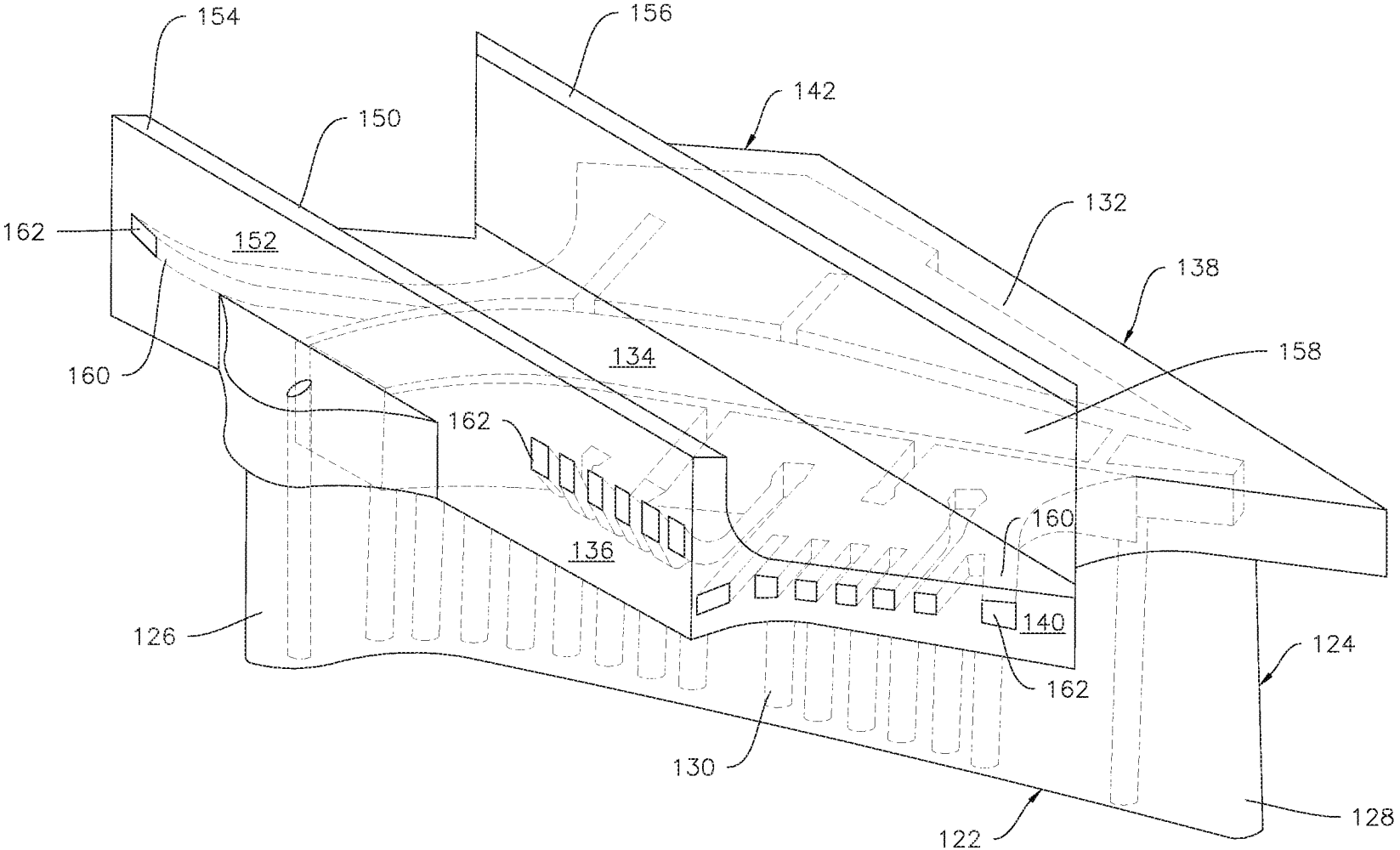
FIG. 3 is a perspective view of a portion of the blade of FIG. 2.

As shown in FIG. 3, the airfoil 114 may define one or more cooling passages 130 extending therethrough. More specifically, the cooling passages 130 may extend from the tip shroud 116 radially inward to the intake port 112. In this respect, cooling flow 36 may flow through the cooling passages 130 from the intake port 112 to the tip shroud 116. In various exemplary embodiments the airfoil 114 may define more or fewer cooling passages 130 than illustrated for example in FIG. 3, and the cooling passages 130 may have any suitable configuration.

As indicated above, the rotor blade 100 includes the tip shroud 116 coupled to the radially outer end of the airfoil 114. In this respect, the tip shroud 116 may generally define the radially outermost portion of the rotor blade 100. The tip shroud 116 reduces the amount of the combustion gases 34 (FIG. 1) that escape past the rotor blade 100.

As shown in FIG. 3, the tip shroud 116 may include a platform 132. The platform 132 may include an outer surface 134, e.g., a surface which is oriented radially outward and defines the radially outermost boundary of the platform 132, extending generally perpendicularly to the airfoil 114. The platform 132 may also include a forward surface 136 oriented generally perpendicular to the hot gas path 32 of the turbomachine 10 proximate to the leading edge 126 of the airfoil 114, an aft surface 138 proximate to the trailing edge 128 of the airfoil 114, a first side surface 140 extending between the forward surface 136 and the aft surface 138 proximate to the pressure side surface 122 of the airfoil 114, and a second side surface 142 extending between the forward surface 136 and the aft surface 138 proximate to the suction side surface 124 of the airfoil 114.

The tip shroud 116 may include a forward seal rail 150 extending radially outwardly therefrom. In particular, the forward seal rail 150 may extend radially outward from the outer surface 134 of the platform 132 proximate to the forward surface 136 of the platform 132. The forward seal rail 150 may be oriented generally perpendicular to the hot gas path 32 of the turbomachine 10. The tip shroud 116 may also include an aft seal rail 156. Alternate embodiments, however, may include more or fewer seal rails 150 (e.g., no seal rails, one seal rail, three seal rails, etc.).

The tip shroud 116 defines various passages, cavities, and apertures to facilitate cooling thereof. More specifically, the tip shroud 116 defines a cooling cavity 158 in fluid communication with one or more of the cooling passages 130. The cooling cavity 158 may be defined in a central portion of the platform 132 of the tip shroud 116. The cooling cavity 158 may be a single continuous cavity in some embodiments. Alternately, as shown in FIG. 3, the cooling cavity 158 may include different chambers fluidly coupled by various passages or apertures. The tip shroud 116 also includes one or more cooling channels 160 extending from the cooling cavity 158. Each cooling channel 160 extends to an ejection slot 162. The cooling channels 160 may have any suitable cross section shape, such as but not limited to, circular, rectangular, elliptical, etc.

During operation of the gas turbine engine 10, cooling flow 36 flows through the passages 130 to cooling cavity 158 and through the cooling channels 160 to ejection slots 162 to cool the tip shroud 116. More specifically, cooling flow 36 (e.g., bleed air from the compressor section 14) enters the rotor blade 100 through the intake port 112 (FIG. 2). At least a portion of this cooling flow 36 flows through the cooling passages 130 and into the cooling cavity 158 in the tip shroud 116. While flowing through the cooling cavity 158 and the cooling channels 160, the cooling flow 36 convectively cools the various walls of the tip shroud 116. The cooling flow 36 may then exit the cooling cavity 158 through the cooling channels 160 and the ejection slots 162.

Figure 4:
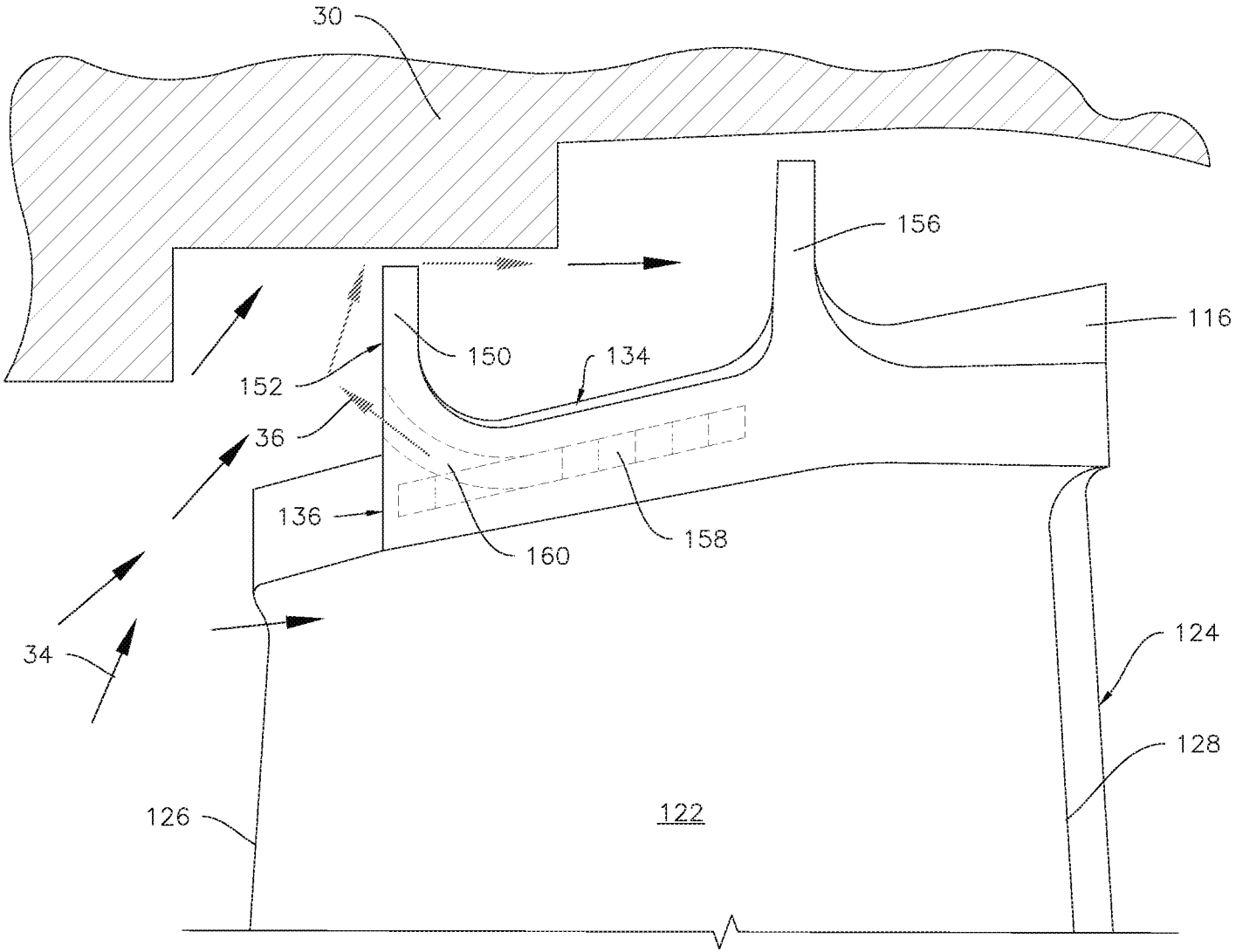
FIG. 4 is a side view of a portion of the blade of FIG. 3.

As may be seen in FIG. 3, the tip shroud 116 may include a plurality of ejection slots 162 formed in the platform 132, e.g., in the aft surface 138, the first side surface 140, and/or the second side surface 142. Cooling channels 160 extending between the cooling cavity 158 and such ejection slots 162 may extend along a direction that is generally parallel to the outer surface 134 of the platform 132. However, there are preferably no ejection slots 162 in the forward surface 136 of the platform 132. At least one ejection slot 162 may be positioned radially outward of the outer surface 134 of the platform 132 of the tip shroud 116. Further, such ejection slots 162 may be configured to direct cooling flow 36 away from the hot gas path 32.

Where the forward surface 136 of the platform 132 is oriented generally perpendicular to the hot gas path 32, cooling flow 36 emanating from any ejection slots 162 therein may flow head-to-head with combustion gases 34 flowing along the hot gas path 32. As such, positioning one or more ejection slots 162 radially outward of the outer surface 134 of the platform 132 may advantageously prevent or minimize mixing of the combustion gases 34 with the cooling flow 36. Mixing of the combustion gases 34 with the cooling flow 36 may result in decreased thermal energy of the combustion gases, such that less work can be produced. In particular, where such mixing does not occur at or near the pressure side surface 122, the efficiency of the turbomachine may be improved. Further, as illustrated in FIG. 4, such configurations may advantageously provide increased efficiency of the turbomachine 10 in that directing the cooling flow 36 upwards (e.g., radially outwards), influences the cooling flow 36 to travel to a clearance gap between the casing 30 and the forward rail 150, which prevents or reduces hot gas 34 leaking over the forward rail 150, such that more hot gas 34 passes over the through airfoil 114 and more work may thereby be extracted from the hot gas 34. Additionally, where the pressure of the cooling flow 36 is sufficiently less than the pressure of the combustion gases 34, positioning one or more ejection slots 162 radially outward of the outer surface 134 of the platform 132 rather than in the forward surface 136 of the platform may prevent or minimize ingestion of combustion gases 34 into the cooling structures of the blade 100 via the ejection slots 162, thereby reducing the heat load on the blade 28. Reducing the heat load may advantageously reduce cooling requirements and/or provide extended life for the blade 28. Positioning the ejection slots 162 radially outward of the outer surface 134 of the platform 132 of the tip shroud 116 and configuring such ejection slots 162 to direct cooling flow 36 up towards the tip and away from the hot gas path 32 may have additional benefits.

Where the cooling cavity 158 is positioned within the platform 132 of the shroud 116, e.g., radially inward of the outer surface 134, and one or more of the ejection slots 162 are positioned radially outward of the outer surface 134 of the platform 132, the cooling channels 160 extending between the cooling cavity 158 and such ejection slots 162 may generally include a first portion 164 and a second portion 166, e.g., as illustrated in FIGS. 5 through 11. The first portion 164 may be proximate to the cooling cavity 158 and may extend from the cooling cavity 158 to the second portion 166. The first portion 164 may be linear and may extend along a direction generally parallel to the outer surface 134 of the platform 132. The second portion 166 may then extend from the first portion 164 to the ejection slot 162, and the second portion 166 may be configured to make up the radial offset between the ejection slot 162 and the first portion 164 and/or cooling cavity 158. The second portion 166 may have additional features as well.

Figure 5:
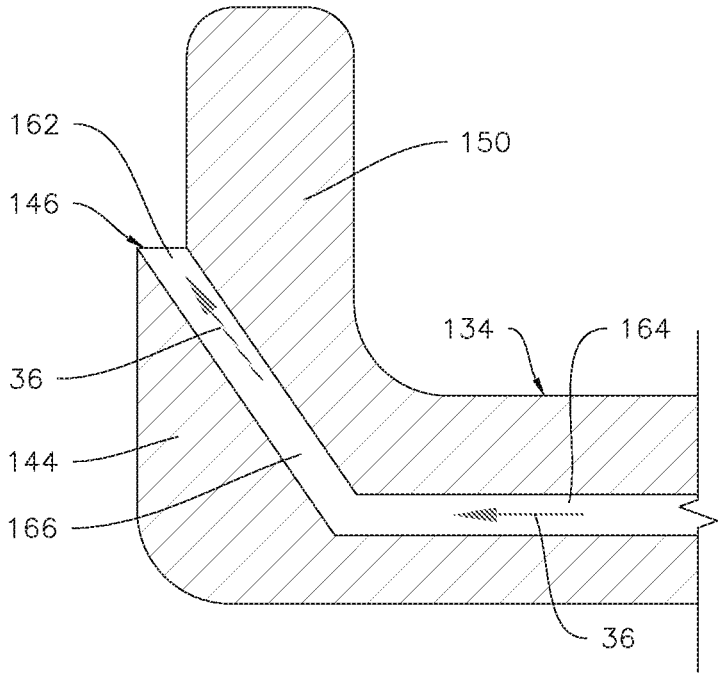
FIG. 5 is a section view of the blade of FIG. 3 according to with one or more additional embodiments of the present disclosure.
Figure 6:
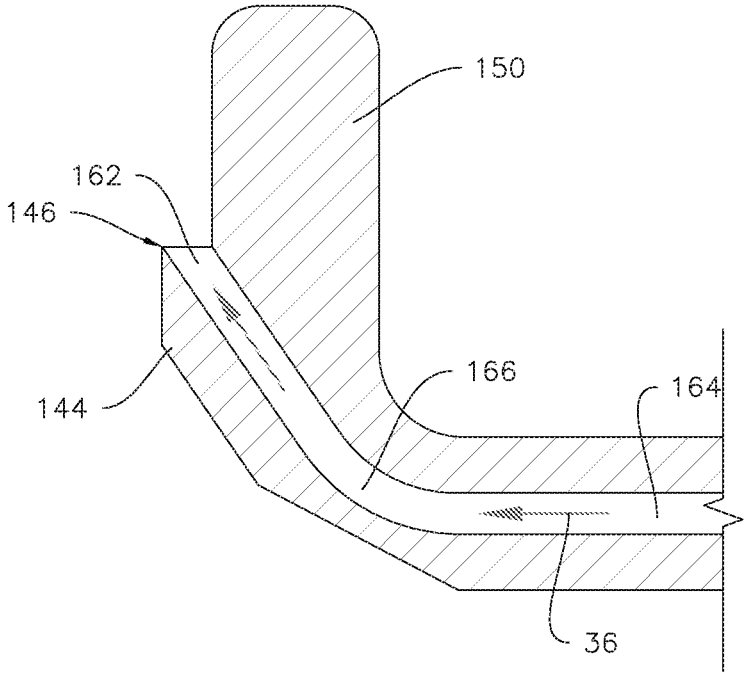
FIG. 6 is a section view of the blade of FIG. 3 according to one or more additional embodiments of the present disclosure.

As a first example, in the illustrated embodiments of FIGS. 3, 4, and 6 the second portion 166 is arcuate, e.g., the cooling channel 160 may comprise a first, portion 164 which is linear and a second portion 166 which is arcuate. As another example, in some embodiments, as illustrated in FIG. 5, the second portion 166 may be linear and may be oblique to the first portion 164 of the cooling channel 160. Also illustrated in FIGS. 5 and 6, some embodiments may include an axial lip 144 formed in the forward rail 150 of the tip shroud 116, e.g., the axial lip 144 may be a step or lip which projects upstream along the axial direction from the forward rail 150 and/or forward surface 136. In some embodiments, such as the illustrated embodiment of FIG. 5, the axial lip 144 may define a rounded radially inner corner. In some embodiments, such as the illustrated embodiment of FIG. 6, the axial lip 144 may define a chamfered radially inner corner which may advantageously reduce the weight of the tip shroud 116. In embodiments where the forward rail 150 includes an axial lip 144, the ejection slot may be axially oriented and may be formed in an outer surface 146 of the axial lip 144. Thus, in such embodiments, the ejection slot 162 may be configured to direct the cooling flow 36 radially outward and perpendicular to the hot gas path 32 of the turbomachine 10.

Figure 7:
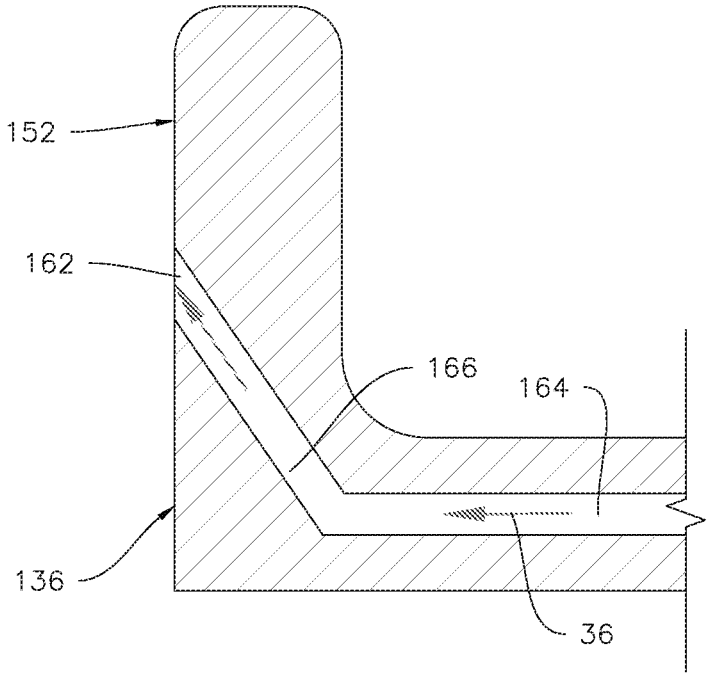
FIG. 7 is a section view of the blade of FIG. 3 according to one or more additional embodiments of the present disclosure.

As illustrated in FIG. 7, in some embodiments, the second portion 166 of the cooling channel 160 may be oblique to the first portion 164 and the ejection slot 162 may be formed in the forward surface 152 of the forward seal rail 150. In such embodiments, the ejection slot 162 may be radially oriented and may be configured to direct the cooling flow 36 radially outward and oblique to the hot gas path 32 of the turbomachine 10.

Figure 8:
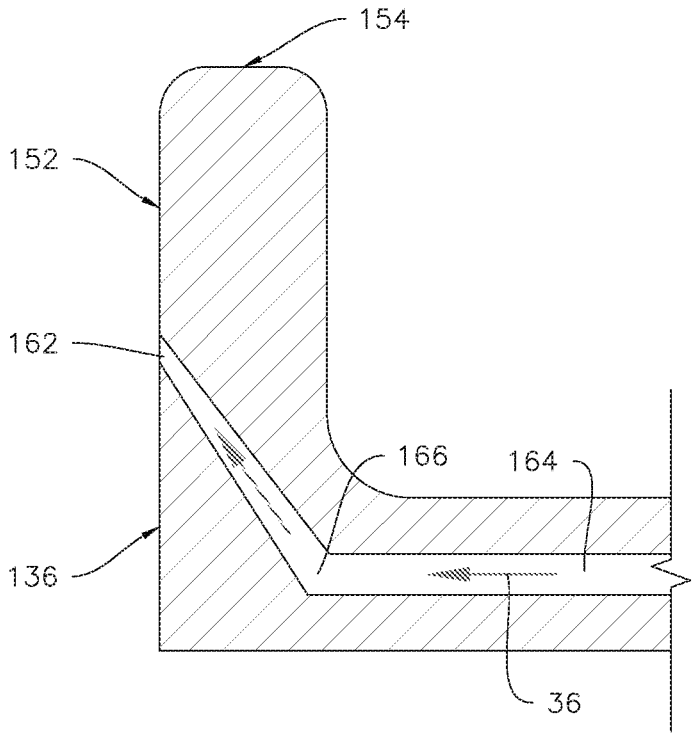
FIG. 8 is a section view of the blade of FIG. 3 according to one or more additional embodiments of the present disclosure.
Figure 9:
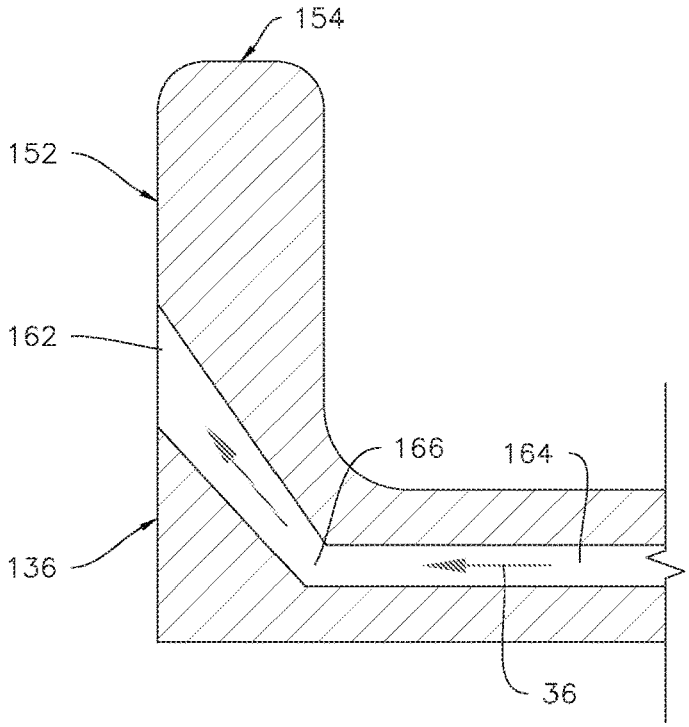
FIG. 9 is a section view of the blade of FIG. 3 according to one or more additional embodiments of the present disclosure.

As another example, in some embodiments, as illustrated in FIGS. 8 and 9, the cooling channel 160 may include a prismatic portion, e.g., the first portion 164 proximate to the cooling cavity 158 may be prismatic, and the cooling channel 160 may further include a non-prismatic portion, e.g., the second portion 166 may be non-prismatic. In various embodiments, the non-prismatic portion may be a converging portion, as shown in FIG. 8, or a diverging portion, as shown in FIG. 9. For example, as illustrated in FIG. 8, the cooling channel 160 may include a converging portion, e.g., the second portion 166 of the cooling channel 160 extending between the prismatic first portion 164 of the cooling channel 160 and the ejection slot 162 may have converging side walls such that the cross-sectional area of the cooling channel 160 decreases from the first portion 164 to the ejection slot 162. Although illustrated in the examples of FIGS. 8 and 9 with linear side walls, the non-prismatic portion may in various other embodiments have curvilinear side walls. Further, combinations of the illustrated embodiments are also possible within the scope of the present disclosure, for example, the non-prismatic portion may include a converging part and a diverging part in various combinations.

Figure 10:
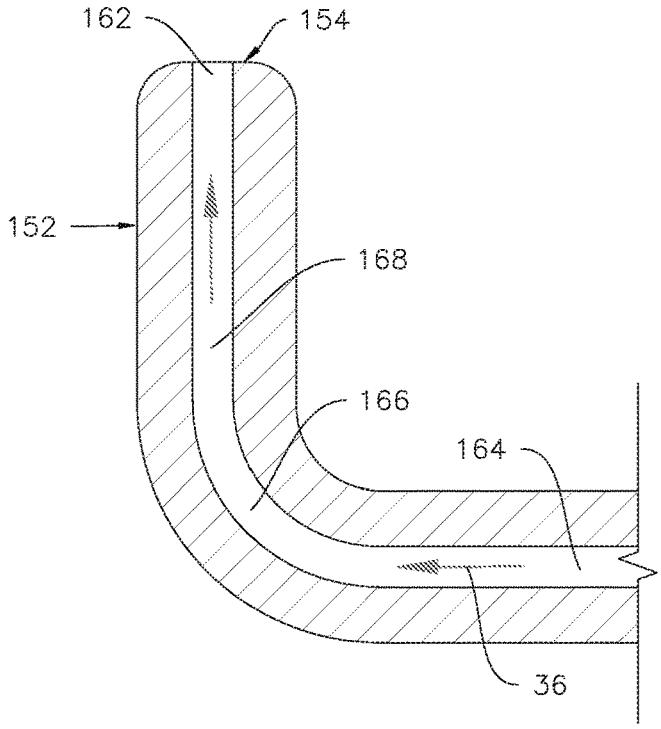
FIG. 10 is a section view of the blade of FIG. 3 according to one or more additional embodiments of the present disclosure.

In some embodiments, for example as illustrated in FIG. 10, the ejection slot 162 may be axially oriented and may be formed in an outer surface 154 of the forward rail 150 of the tip shroud 116. Also illustrated in FIG. 10, in such embodiments, the cooling channel 160 may include a linear first portion 164 which extends generally parallel to outer surface 134, an arcuate second portion 166 which extends between the first portion 164 and the ejection slot 162, e.g., from the first portion 164 to a third portion 168, where the third portion 168 extends from the second portion 166 to the ejection slot 162. In such embodiments, the third portion 168 may extend along a direction that is generally parallel to the forward surface 152 of the forward rail 150. As shown in FIG. 10, the example embodiment includes a rounded radially inner corner of the platform 132 of the tip shroud 116. It is also possible in other example embodiments to provide a chamfered radially inner corner of the platform 132 of the tip shroud 116, and some such embodiments may also include a linear second portion 166 of the cooling channel 160 which may be oblique to the first portion 164 and the third portion 168. Further, the linear second portion 166 may, for example, extend along a direction that is generally parallel to the chamfered radially inner corner of the platform 132 of the tip shroud 116.

Figure 11:
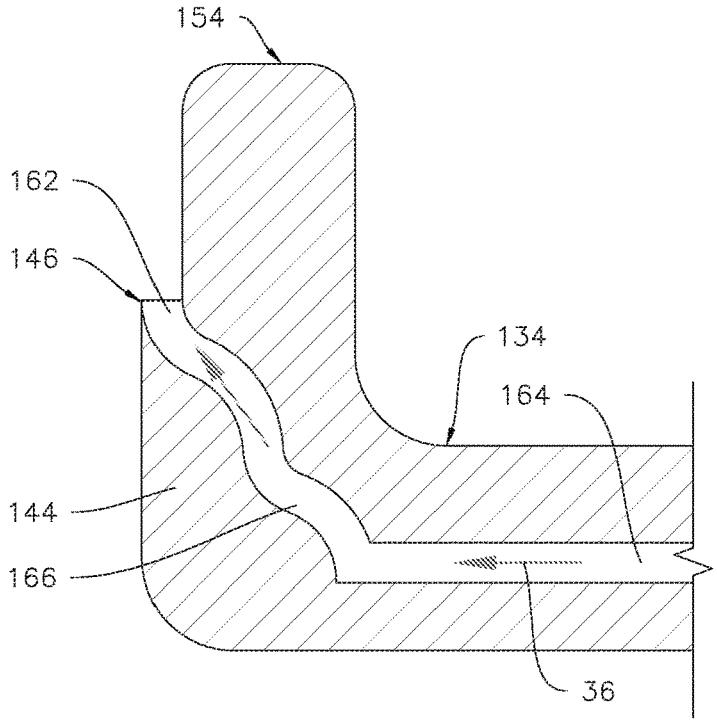
FIG. 11 is a section view of the blade of FIG. 3 according to one or more additional embodiments of the present disclosure.
Figure 12:
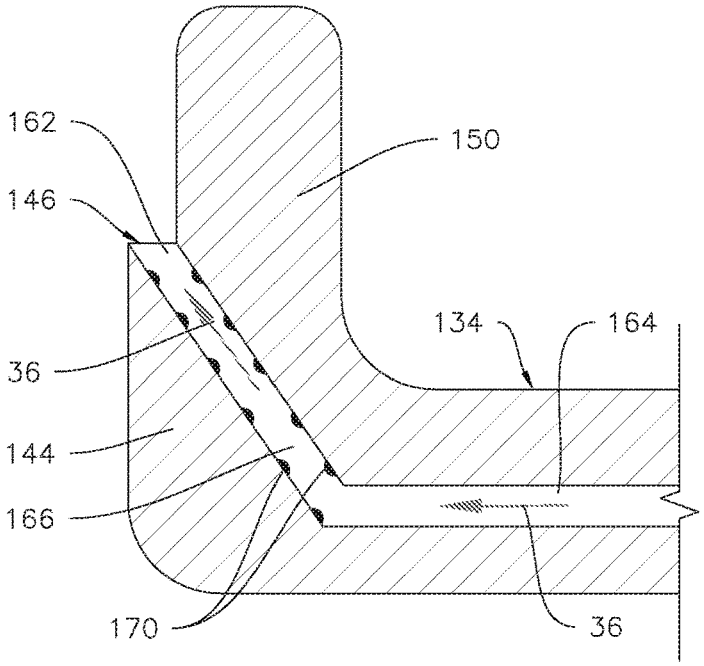
FIG. 12 is a section view of the blade of FIG. 3 according to one or more additional embodiments of the present disclosure.

As mentioned above, the second portion 166 may have additional features as well, such as turbulator features. Such turbulator features may create turbulence in the cooling flow 36 flowing through the cooling channel 160, which increases the rate of convective heat transfer from the tip shroud 116 by the cooling flow 36. For example, as illustrated in FIG. 11, the second portion 166 may have an undulating shape to create turbulence in the cooling flow 36 therethrough. As another example, as illustrated in FIG. 12, the second portion 166 may include a plurality of projections 170 formed therein to create turbulence in the cooling flow 36 therethrough.

Figure 14:
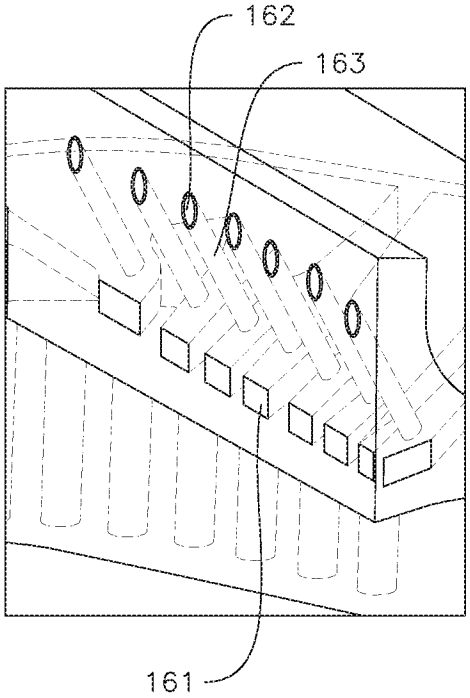
FIG. 14 is an enlarged view of a portion of FIG. 13.
Figure 13:
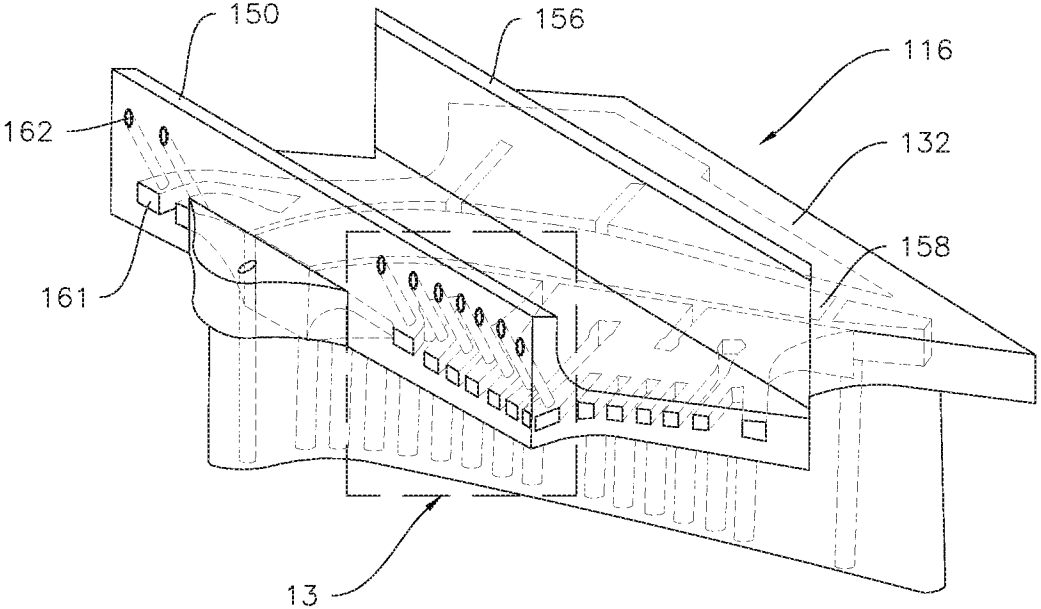
FIG. 13 is a perspective view of a portion of an exemplary blade according to one or more embodiments of the present disclosure.

In another embodiment of the present disclosure, a method of forming a cooling channel in a tip shroud of a blade for a turbomachine may be provided, as illustrated in FIGS. 13 and 14. The method may include forming an oblique cooling channel 163 in an existing tip shroud 116, where the existing tip shroud 116 may include an existing ejection slot 161 of a cooling channel 160 defined in the tip shroud 116. For example, the existing ejection slot 161 may be formed in forward surface 136, e.g., cooling flow 36 emanating from the existing ejection slot 161 may be directed head-to-head with the combustion gases 34. Accordingly, an example method may include a step of plugging the existing ejection slot 161. The example method may further include forming a new ejection slot 162 radially outward of the existing ejection slot 161. For example, as illustrated in FIGS. 13 and 14, the new ejection slot 162 may be formed in the forward rail 150, e.g., in the forward surface 152 thereof. The example method may further include forming a bore 163 from the new ejection slot 162 to an intermediate portion of the cooling channel 160, as shown in FIG. 14.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A blade for a turbomachine, comprising:

an airfoil extending radially between a root and a tip, the airfoil including a pressure side surface extending from a leading edge to a trailing edge and a suction side surface extending from the leading edge to the trailing edge opposite the pressure side surface;

a tip shroud coupled to the tip of the airfoil, the tip shroud comprising:

a platform comprising an outer surface extending generally perpendicularly to the airfoil, a forward surface oriented generally perpendicular to an axial centerline of the turbomachine proximate to the leading edge of the airfoil, an aft surface proximate to the trailing edge of the airfoil, a first side surface extending between the forward surface and the aft surface proximate to the pressure side surface of the airfoil, and a second side surface extending between the forward surface and the aft surface proximate to the suction side surface of the airfoil;

a forward rail extending radially outward from the outer surface of the platform proximate to the forward surface of the platform, the forward rail oriented generally perpendicular to the axial centerline of the turbomachine, and wherein the forward rail extends continuously across the airfoil;

a cooling cavity defined in a central portion of the platform of the tip shroud; and a cooling channel extending between the cooling cavity and an ejection slot formed in the forward rail, the ejection slot positioned radially outward of the outer surface of the platform of the tip shroud, wherein the cooling channel comprises a first portion proximate to the cooling cavity, the first portion extending parallel to the outer surface of the platform between the cooling cavity and a second portion of the cooling channel oblique to the first portion of the cooling channel, the second portion of the cooling channel extending between the first portion of the cooling channel and the ejection slot.

2. The blade of claim 1, wherein the ejection slot is configured to direct a cooling flow radially outward and oblique to the axial centerline of the turbomachine.

3. The blade of claim 1, wherein the ejection slot is configured to direct a cooling flow radially outward and perpendicular to the axial centerline the turbomachine.

4. The blade of claim 1, wherein the cooling channel comprises a linear portion proximate to the cooling cavity, the linear portion extending parallel to the outer surface of the platform between the cooling cavity and an arcuate portion of the cooling channel, the arcuate portion of the cooling channel extending between the linear portion of the cooling channel and the ejection slot.

5. The blade of claim 1, wherein the cooling channel comprises a prismatic portion proximate to the cooling cavity, the prismatic portion extending between the cooling cavity and a non-prismatic portion of the cooling channel, the non-prismatic portion of the cooling channel extending between the prismatic portion of the cooling channel and the ejection slot.

6. The blade of claim 1, wherein the cooling channel comprises a first portion proximate to the cooling cavity, the first portion extending between the cooling cavity and a second portion of the cooling channel, the second portion of the cooling channel having a turbulator defined therein.

7. The blade of claim 1, wherein the ejection slot is formed in a forward surface of the forward rail of the tip shroud.

8. The blade of claim 1, further comprising an axial lip formed in the forward rail of the tip shroud, and wherein the ejection slot is formed in an outer surface of the axial lip.

9. The blade of claim 1, wherein the ejection slot is formed in an outer surface of the forward rail of the tip shroud.

10. The blade of claim 1, wherein the ejection slot is axially oriented.

11. The blade of claim 1, wherein the ejection slot is radially oriented.

12. A gas turbine, comprising;

a compressor;

a combustor disposed downstream from the compressor;

a turbine disposed downstream from the combustor, the turbine including a rotor shaft extending axially through the turbine, an outer casing circumferentially surrounding the rotor shaft to define a hot gas path therebetween and a plurality of rotor blades interconnected to the rotor shaft and defining a stage of rotor blades, wherein each rotor blade comprises;

an airfoil extending radially between a root and a tip, the airfoil including a pressure side surface extending from a leading edge to a trailing edge and a suction side surface extending from the leading edge to the trailing edge opposite the pressure side surface;

a tip shroud coupled to the tip of the airfoil, the tip shroud comprising:

a platform comprising an outer surface extending generally perpendicularly to the airfoil, a forward surface oriented generally perpendicular to an axial centerline of the gas turbine proximate to the leading edge of the airfoil, an aft surface proximate to the trailing edge of the airfoil, a first side surface extending between the forward surface and the aft surface proximate to the pressure side surface, and a second side surface extending between the forward surface and the aft surface proximate to the suction side surface;

a forward rail extending radially outward from the outer surface of the platform proximate to the forward surface of the platform, the forward rail oriented generally perpendicular to the axial centerline of the gas turbine, and wherein the forward rail extends continuously across the airfoil;

a cooling cavity defined in a central portion of the platform of the tip shroud; and a cooling channel extending between the cooling cavity and an ejection slot formed in the forward rail, the ejection slot positioned radially outward of the outer surface of the platform of the tip shroud, wherein the cooling channel comprises a linear portion proximate to the cooling cavity, the linear portion extending parallel to the outer surface of the platform between the cooling cavity and an arcuate portion of the cooling channel, the arcuate portion of the cooling channel extending between the linear portion of the cooling channel and the ejection slot.

13. The gas turbine of claim 12, wherein the ejection slot is configured to direct a cooling flow radially outward and oblique to the axial centerline of the gas turbine.

14. The gas turbine of claim 12, wherein the ejection slot is configured to direct a cooling flow radially outward and perpendicular to the axial centerline of the gas turbine.

15. The gas turbine of claim 12, wherein the cooling channel comprises a first portion proximate to the cooling cavity, the first portion extending parallel to the outer surface of the platform between the cooling cavity and a second portion of the cooling channel oblique to the first portion of the cooling channel, the second portion of the cooling channel extending between the first portion of the cooling channel and the ejection slot.

16. The gas turbine of claim 12, wherein the cooling channel comprises a prismatic portion proximate to the cooling cavity, the prismatic portion extending between the cooling cavity and a non-prismatic portion of the cooling channel, the non-prismatic portion of the cooling channel extending between the prismatic portion of the cooling channel and the ejection slot.

17. The gas turbine of claim 12, further comprising an axial lip formed in the forward rail of the tip shroud, and wherein the ejection slot is formed in an outer surface of the axial lip.

18. A gas turbine, comprising;

a compressor;

a combustor disposed downstream from the compressor;

a turbine disposed downstream from the combustor, the turbine including a rotor shaft extending axially through the turbine, an outer casing circumferentially surrounding the rotor shaft to define a hot gas path therebetween and a plurality of rotor blades interconnected to the rotor shaft and defining a stage of rotor blades, wherein each rotor blade comprises;

an airfoil extending radially between a root and a tip, the airfoil including a pressure side surface extending from a leading edge to a trailing edge and a suction side surface extending from the leading edge to the trailing edge opposite the pressure side surface;

a tip shroud coupled to the tip of the airfoil, the tip shroud comprising:

a platform comprising an outer surface extending generally perpendicularly to the airfoil, a forward surface oriented generally perpendicular to an axial centerline of the gas turbine proximate to the leading edge of the airfoil, an aft surface proximate to the trailing edge of the airfoil, a first side surface extending between the forward surface and the aft surface proximate to the pressure side surface, and a second side surface extending between the forward surface and the aft surface proximate to the suction side surface;

a forward rail extending radially outward from the outer surface of the platform proximate to the forward surface of the platform, the forward rail oriented generally perpendicular to the axial centerline of the gas turbine, and wherein the forward rail extends continuously across the airfoil;

a cooling cavity defined in a central portion of the platform of the tip shroud; and a cooling channel extending between the cooling cavity and an ejection slot formed in the forward rail, the ejection slot positioned radially outward of the outer surface of the platform of the tip shroud, wherein the cooling channel comprises a first portion proximate to the cooling cavity, the first portion extending parallel to the outer surface of the platform between the cooling cavity and a second portion of the cooling channel oblique to the first portion of the cooling channel, the second portion of the cooling channel extending between the first portion of the cooling channel and the ejection slot.

19. The gas turbine of claim 18, wherein the ejection slot is configured to direct a cooling flow radially outward and oblique to the axial centerline of the gas turbine.

20. The gas turbine of claim 18, wherein the ejection slot is configured to direct a cooling flow radially outward and perpendicular to the axial centerline of the gas turbine.

* * * * *